US011766624B2

(12) United States Patent
LeMoine et al.

(10) Patent No.: US 11,766,624 B2
(45) Date of Patent: Sep. 26, 2023

(54) BEVERAGE DISPENSER TOY

(71) Applicant: Melissa & Doug, LLC, Wilton, CT (US)

(72) Inventors: George LeMoine, Westport, CT (US); Matt Burtonwood, West Yorkshire (GB)

(73) Assignee: Melissa & Doug, LLC, Wilton, CT (US)

( * ) Notice: Subject to any disclaimer, the term of this patent is extended or adjusted under 35 U.S.C. 154(b) by 132 days.

(21) Appl. No.: 17/530,857

(22) Filed: Nov. 19, 2021

(65) Prior Publication Data

US 2023/0158420 A1 May 25, 2023

(51) Int. Cl.
*A63H 33/30* (2006.01)

(52) U.S. Cl.
CPC ..... *A63H 33/3055* (2013.01); *A63H 33/30* (2013.01)

(58) Field of Classification Search
CPC ..... A63H 33/3055; A63H 33/30
See application file for complete search history.

(56) References Cited

U.S. PATENT DOCUMENTS 4,322,909 A 4/1982 Holahan
5,160,288 A * 11/1992 Seda ..... A63H 33/30 446/236
5,344,234 A * 9/1994 Caveza ..... A63H 33/3055 366/252

(Continued)

FOREIGN PATENT DOCUMENTS

CN 205672568 U * 11/2016
CN 206950683 U * 2/2018

(Continued)

OTHER PUBLICATIONS https://www.amazon.com/Hape-Coffee-Wooden-Kitchen-Accessories/dp/B006WZM79O.

(Continued)

*Primary Examiner* — Eugene L Kim
*Assistant Examiner* — Alyssa M Hylinski
(74) *Attorney, Agent, or Firm* — Wissing Miller LLP

(57) ABSTRACT

A toy for simulating the dispensing of a beverage. The toy includes a bench decorated to represent a beverage dispenser, such as an espresso machine. The toy also includes a simulated filter basket. The filter basket has a handle, a disc receiver and a support ring. The handle and disc receiver are rotatably connected with the ring so that, when the handle is rotated, the handle and disc receiver rotate about the horizontal axis with respect to the ring. One or more discs shaped to rest in the disc receiver are provided. Each disc has a decoration on one face showing a material used to create a beverage, for example, ground coffee, and a second face decorated to represent the top surface of a dispensed beverage, for example, a latte. The toy is operated by placing one of the discs in the disc receiver with the face showing the material facing upward. The filter basket is into a slot on the frame and the cup is positioned beneath the disc receiver. The user rotates the handle so that the disc receiver faces downward, flipping the disc over and allowing the disc to drop into the cup with the second face, representing the surface of the dispensed beverage facing upward.

9 Claims, 15 Drawing Sheets

(56) References Cited

U.S. PATENT DOCUMENTS

| | | | | |
|---|---|---|---|---|
| 5,562,927 | A | 10/1996 | Masuda | |
| 10,888,188 | B2 * | 1/2021 | Cirri | A47G 29/1248 |
| 11,179,651 | B2 * | 11/2021 | Kamiyama | A63H 33/3055 |
| 2009/0253346 | A1 * | 10/2009 | Ehama | A63H 33/3055 446/267 |

FOREIGN PATENT DOCUMENTS

| | | | | |
|---|---|---|---|---|
| CN | 208018162 | U | * | 10/2018 |
| CN | 210356041 | U | * | 4/2020 |
| EP | 2113293 | | | 11/2009 |

OTHER PUBLICATIONS https://www.hape.com/us/en/toy/my-coffee-machine/E3146.
https://www.amazon.com/BLACK-DECKER-Coffee-Maker-Sound/dp/B07P1GBVM5/ref=pd_sbs_3/145-3440870-2200109?pd_rd_w=cVcVL&pf_rd_p=cc1c437d-ebe7-44ed-9018-890d5eab4e8d&pf_rd_r=QDPYVJ0WSJVPWY75KT4E&pd_rd_r=e8767368-0975-4614-a5f7-82751845c280&pd_rd_wg=ouypq&pd_rd_i=B07P1GBVM5&psc=1.
https://www.tinylandus.com/collections/kids-toys/products/wooden-coffee-maker.
https://www.amazon.com/PairPear-Coffee-Maker-Espresso-Playset/dp/B08T6QHG6T/ref=pd_sbs_10/145-3440870-2200109?pd_rd_w=XEnFh&pf_rd_p=cc1c437d-ebe7-44ed-9018-890d5eab4e8d&pf_rd_r=34GT2TYZBA6XJJ4Y0AJC&pd_rd_r=272af9bd-24ff-4e9a-ae28-2b6dec80ee68&pd_rd_wg=Q8pf5&pd_rd_i=B08T6QHG6T&psc=1.
https://store.leapfrog.com/en-us/store/p/sweet-treats-learning-cafe-aqua-blue/_/A-prod80-601070.
https://www.tenderleaftoys.com/products/bird-s-nest-cafe?_pos=1&_sid=2e03e718e&_ss=r.
https://www.tenderleaftoys.com/products/babyccino-maker?_pos=2&_sid=d95472ec5&_ss=r.
https://www.klein-toys-shop.de/en/Products/Kitchen-Equipment/Shops/COFFEE-SHOP.html?isttype=search&searchparam=coffee.
https://letoyvan.com/products/cafe-machine?_pos=11&_sid=a74bbd280&_ss=r?variant=.
https://www.gltc.co.uk/products/star-beans-coffee-shop.
European Search Report for EP22208435, completed Mar. 17, 2023.
https://www.melissaanddoug.com/wooden-brew-and-serve-coffee-set/9842.html.

* cited by examiner

BEVERAGE DISPENSER TOY

BACKGROUND OF THE INVENTION

1. Field of the Invention

The present disclosure relates to a beverage dispenser toy that provides the experience of operating a beverage dispenser. More particularly, the present disclosure relates to an apparatus that simulates preparing a beverage and that safely provides the user with the experience of preparing a hot beverage, such as coffee, tea, cappuccino, latte, and the like.

2. Description of the Related Art

Children enjoy playing games where they have the sensation that they are acting as an adult. Toys such as simulated cash registers, retail stores, food kiosks, and other structures can provide children with the experience of performing a task normally reserved for adults. Such toys provide entertainment and can help children develop skills, such as arithmetic when making change. Playing games with such toys may help children develop social skills such as speaking politely, responding to questions, and interacting with others as an adult would do in a retail establishment.

The experience of a toy that simulates adult activities may be enhanced where the simulated activity is something children are normally not allowed to do. Toys that allow children to imaging they are driving a car or truck, sailing a boat, or flying a plane may provide a child with a more engaging experience because the activity is something they typically would not be allowed to do because it may be dangerous.

There is a need for a toy that allows children to experience the sensation of acting as a "barista," that is, a person skilled in preparing different kind of hot beverages. Dispensing hot beverages is normally something children would not be allowed to do. Equipment, such as coffee grinders, burners, and steam generators are commonly used in settings children are likely to be familiar with, for example, restaurants and coffee shops. Servers at these establishments handle hot beverages and boiling water. Creating beverages such as an espresso or a latte requires grinding coffee beans and opening and closing valves to apply steam and hot water to create the drink. Such an experience may be particularly exciting for children.

BRIEF SUMMARY OF THE INVENTION

Embodiments of the disclosure provide a toy that includes a mechanism to simulate the preparation of hot beverages, such as coffee, tea, hot chocolate, and beverages that require using steam and/or hot water to create foam, such as for latte, cappuccino, and the like.

According to one embodiment, a toy includes one or more discs decorated on a first side to represent a material used to create a hot beverage, such as ground coffee, dried tea leaves, powdered hot chocolate, or the like and a second side that is decorated to represent the top surface of a prepared beverage, such as the black or brown top surface of a cup of coffee, or the white or off-white surface of a foamed beverage such as latte or cappuccino. The toy further includes a filter basket shaped to resemble a portafilter typically used with an espresso machine. The filter basket includes a ring, a handle, and a disc receiver. The handle and disc receiver are fixed together and rotatably connected with the ring so that the disc receiver can be rotated by turning the handle relative to the ring. The disc receiver has a ridge or cavity on at least one side shaped to hold one of the discs. According to one embodiment, the toy includes a frame that has a slot sized to receive and support the ring and, once the ring is inserted into the slot, to allow the disc receiver to rotate. The toy also includes a cup shaped to fit within the frame below the slot. According to one embodiment, the cup has an inner diameter shaped so that, when the disc is placed in the cup, the disc is held in a horizontal orientation so that one or the other face of the disc faces upward.

According to another embodiment, the disclosure provides a method for using a simulated beverage dispenser. A user selects a two-sided disc that corresponds to the kind of beverage they want to pretend to create. A first side represents a starting material, for example, ground coffee, and a second side represents the top surface of a finished beverage made using the starting material, for example, the foamed top of a latte or a cappuccino. The user places the selected disc in a simulated filter basket with the first side facing upward and the second side facing downward. The user inserts the filter basket into a slot provided on a frame. The user places a cup below the filter basket, where the cup is shaped to support the disc once the disc falls into the cup. The user turns a rotatable handle of the filter basket, causing the disc to be rotated so that the second face is directed upward. In this orientation, the disc drops from the filter basket and falls into the cup with the second face directed upward. As a result, the cup appears to be filled with the dispensed beverage.

According to some embodiments, the frame is connected with a bench or service counter. The service counter may include other components to enhance the experience of preparing beverages. According to one embodiment, the counter includes a simulated steam dispenser and a knob decorated to appear to operate a steam valve. According to other embodiments, the counter includes components associated with a retail store, such as a cash register, a tip jar, a blender, and the like.

According to other embodiments there is disclosed a toy beverage dispenser comprising a frame including a slot and a filter basket. The filter basket comprises a handle, a disc receiver fixed with the handle, and a ring surrounding the disc receiver, wherein the handle and the disc receiver are rotatably connected with the ring to rotate about a horizontal axis, and wherein the ring is shaped to removably fit into the slot. The to also comprises a disc including a first face and a second face and a cup. The cup is shaped to fit within the frame below the slot. The disc receiver is shaped to support the disc when the disc receiver is oriented substantially horizontally. The disc falls from the disc receiver into the cup when the disc receiver is rotated about the horizontal axis. The first face of the disc may comprise a decoration representing a material used to create a simulated beverage and the second face may comprise a decoration representing a top surface of the simulated beverage. The cup may be shaped to receive the disc and to hold the disc in a horizontal orientation. The disc receiver may comprise a first cavity shaped to releasably hold the disc. The disc receiver may further comprise a second cavity on a side opposite from the first cavity, wherein the second cavity is shaped to releasably hold the disc. The slot may include one or more supports, wherein the supports releasably hold the ring within the slot. The cup may comprise a stepped region proximate an upper rim of the cup, and wherein a diameter of the cup above the stepped region is larger than a diameter of the disc and wherein the diameter of the cup below the stepped region is less than the diameter of the disc, wherein, when the disc falls into the cup, the disc is supported by the stepped region. The height of the stepped region may be less than, equal to, or greater than a thickness of the disc.

According to still other embodiments there is disclosed a method of simulating dispensing a beverage comprising providing one or more discs, the discs each including a first face and a second face, providing a simulated filter basket, the basket shaped to receive a selected disc of the one or more discs in a disc receiver, wherein the disc receiver is rotatable about a horizontal axis, positioning a cup below the simulated filter basket, orienting the disc receiver horizontally, inserting the selected disc in the disc receiver with a first face of the disc facing upward, and rotating the disc receiver about the horizontal axis, wherein the disc falls from the disc receiver and into the cup with the second face of the disc facing upward.

According to another aspect of the disclosure, toys embodying the disclosed structure can be created with a variety of shapes and configurations to simulate other types of beverage dispensers.

According to another aspect of the disclosure, the structure is formed from components that are simple to manufacture and assemble.

According to another aspect of the disclosure, toys embodying the disclosed structure are lightweight and easy to store and transport.

According to another aspect of the disclosure, toys embodying the disclosed structure are durable.

BRIEF DESCRIPTION OF THE DRAWINGS

The above and/or other aspects of the disclosure will be more apparent by describing in detail exemplary embodiments of the disclosure with reference to the accompanying drawings, in which.

DETAILED DESCRIPTION OF EXEMPLARY EMBODIMENTS

Figure 1:
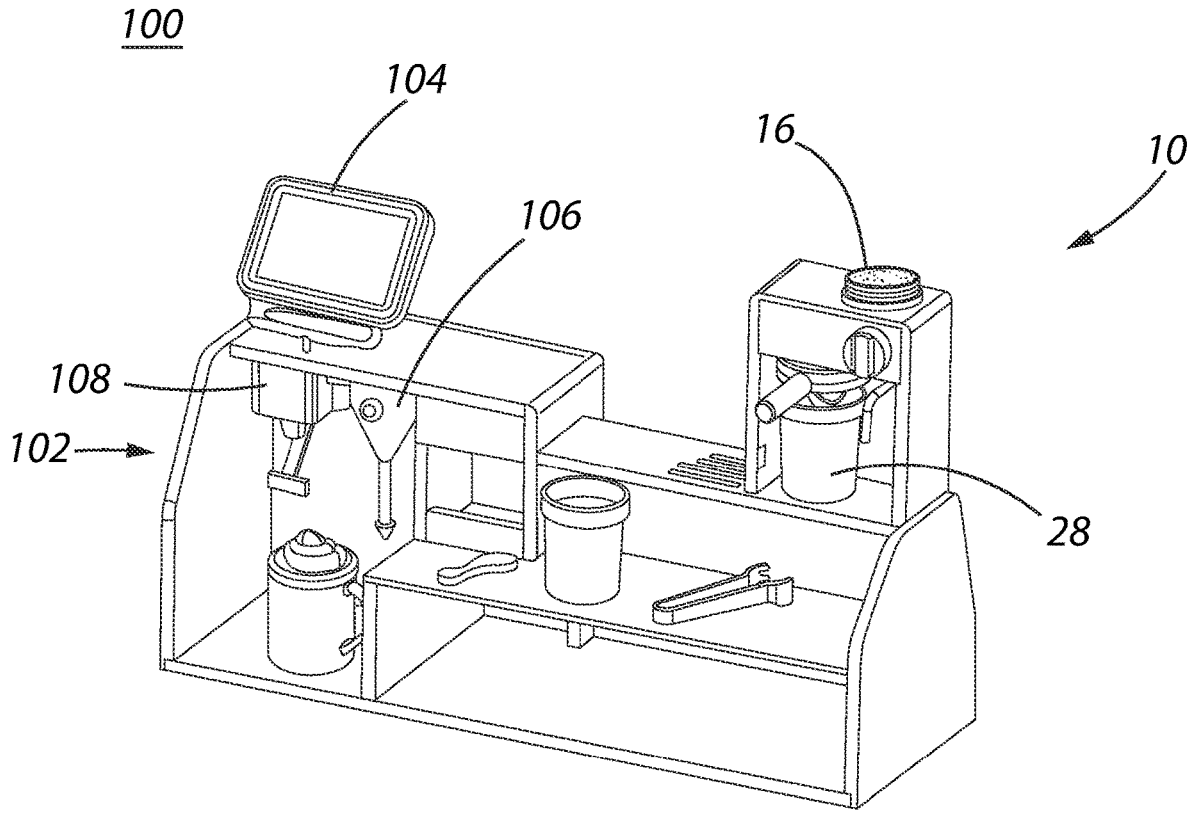
FIG. 1 is a perspective view of a counter including a simulated beverage dispenser according to embodiments of the disclosure.

Exemplary embodiments of the disclosure will now be described below by reference to the attached Figures. The described exemplary embodiments are intended to assist the understanding of the invention and are not intended to limit the scope of the invention in any way. Like reference numerals refer to like elements throughout.

FIG. 1 shows a toy 100 according to one embodiment of the disclosure. In this exemplary embodiment, the toy simulates the counter of a retail establishment where beverages are sold, such as a restaurant, a coffee shop, or the like. The toy includes a bench or counter 102. The bench may include decorations suggestive of the retail establishment. In the example, shown in FIG. 1, the bench 102 includes accessories, such as a cash register or point of sale computer screen 104, a blender 106, and a soda dispenser 108. Printing or decals may be provided on bench 102, for example, showing a price list and the like to evoke the sensation of a retail establishment. The disclosure is not limited to a bench or counter including these accessories and encompasses other sorts of accessories and decorations, as well as embodiments without such accessories or decorations.

Connected with bench 102 is a beverage dispenser 10 according to embodiments of the disclosure. One or more discs 16 are provided on dispenser 10 or elsewhere on bench 102.

Figure 2A:
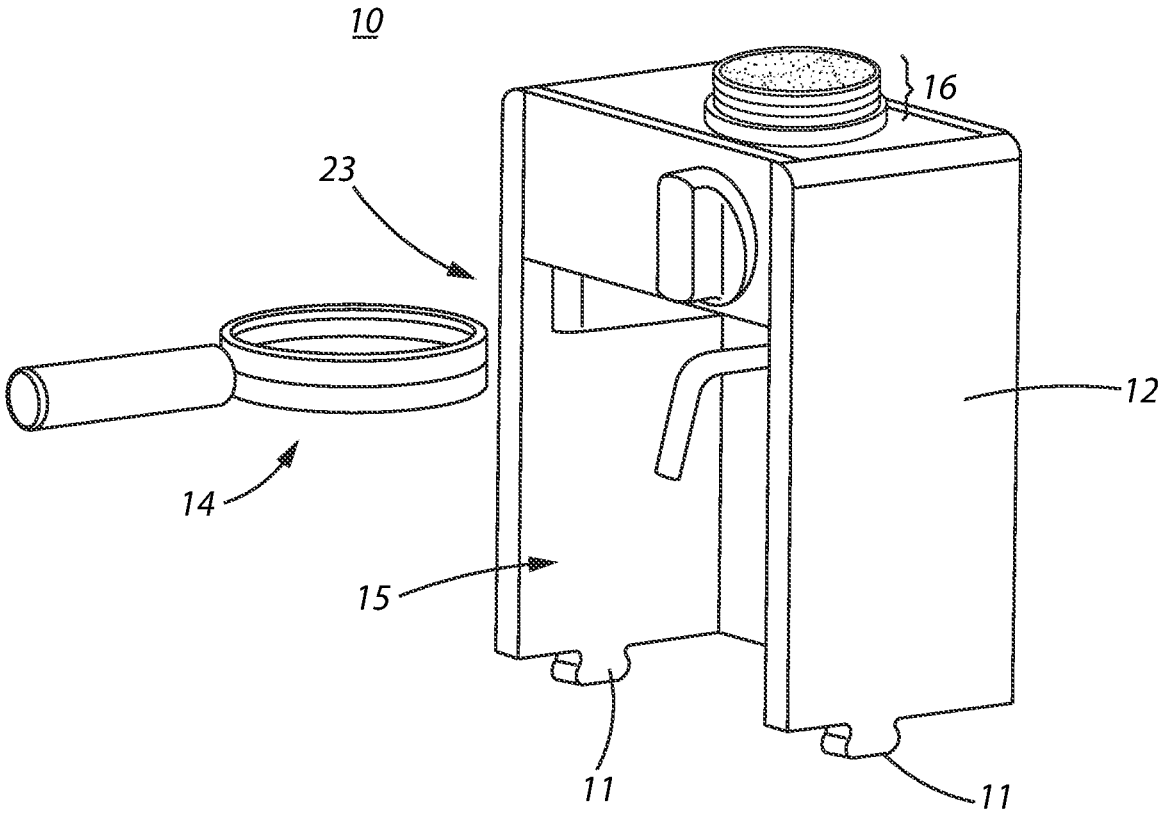
FIGS. 2A and 2B are perspective views of the simulated beverage dispenser of FIG. 1 showing insertion of a filter basket into a frame of the beverage dispenser.
Figure 2B:
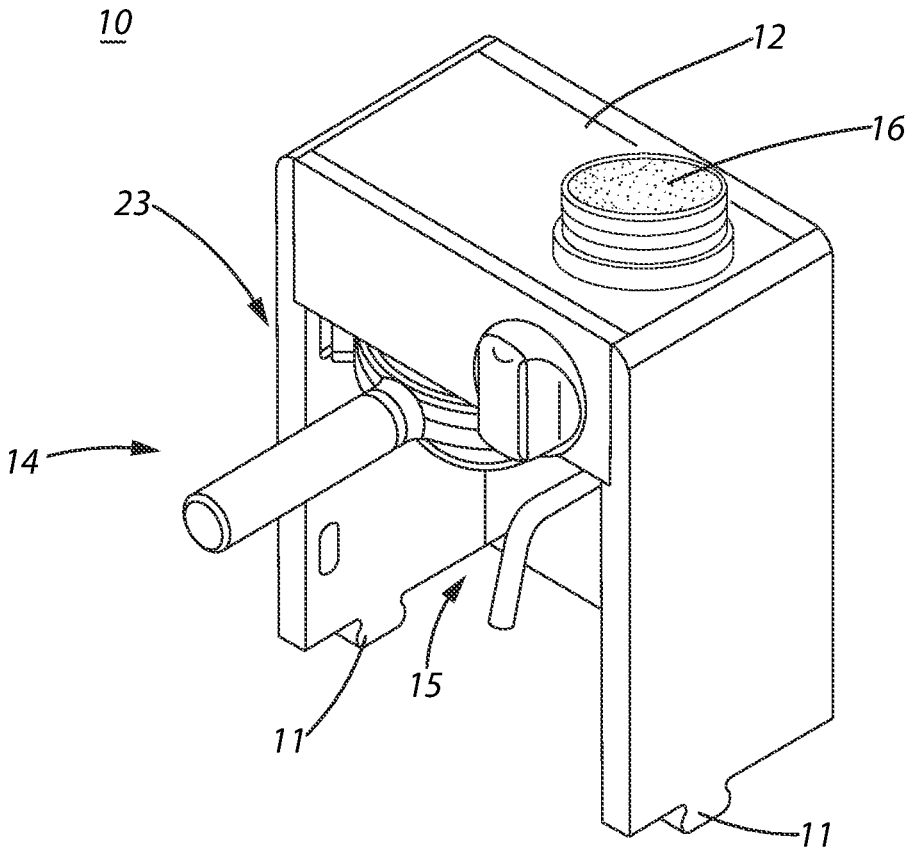

FIGS. 2A and 2B show detailed views of beverage dispenser 10. One or more discs 16 are shown stacked on top of the dispenser. The dispenser comprises a frame 12. According to one embodiment frame 12 is connected with bench 102 by tabs 11 at the bottom of frame 12. Tabs 11 engage with slots (not shown) on bench 102. According to one embodiment, engagement of tabs 11 with slots in the bench permanently affix frame 12 to bench 102, for example, by including snap-fit engagements on the bench, on the frame, or on both. Providing a frame 12 that can be joined with bench 102 facilitates packaging and shipping toy 100 by allowing the components to be packaged and shipped more compactly. According to another embodiment, tabs 11 on frame 12 removably connected the frame with bench 102 to allow the toy 100 to be disassembled, for example, when the toy is stored. According to a further embodiment, engagement of tabs 11 with bench 102 allows dispenser 10 to release from the bench in the event that the toy 100 is dropped, allowing the frame and bench to separate without damage. Such an embodiment may improve the durability of toy 100.

Frame 12 includes slot 23. Slot 23 is shaped to receive and support filter basket 14. As will be explained more fully below, filter basket 14 is slidably and removably received in slot 23. FIG. 2A shows filter basket 14 separated from frame 12. FIG. 2B shows filter basket 14 inserted into slot 23 on frame 12. Frame 12 provides an open area 15 below slot 23 to fit a cup, as will be explained below.

Figures 3A, 3B, 3C:
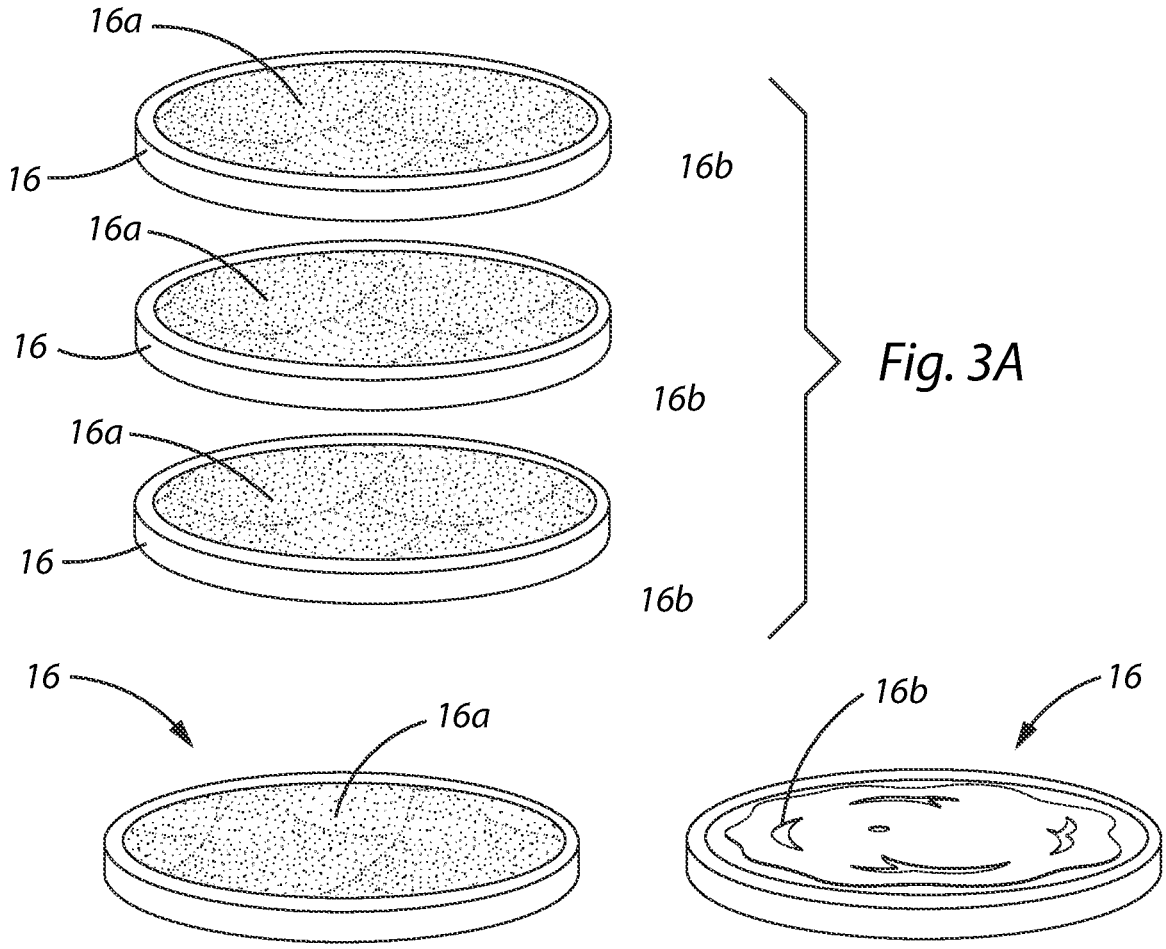
FIGS. 3A, 3B and 3C are perspective views of discs that form part of the simulated beverage dispenser of FIG. 1.

FIG. 3A shows a stack of discs 16. As shown in FIGS. 3B and 3C, a first face 16*a* of each of the discs 16 has a decoration representing a material typically used to prepare a beverage. Face 16*a* may be decorated to represent ground coffee, coffee beans, tea leaves, hot chocolate powder, and the like. As shown in FIG. 3C, a second face 16*b* of disc 16 includes a different decoration than what is provided on first face 16*a*. Second face 16*b* is decorated to represent the top surface of a finished beverage that corresponds with the material shown in first face 16*a*. For example, if face 16*a* of a selected disc 16 is decorated to represent ground coffee, second face 16*b* may be decorated to represent a finished coffee-based beverage, such as a latte or a cappuccino.

Figure 4A:
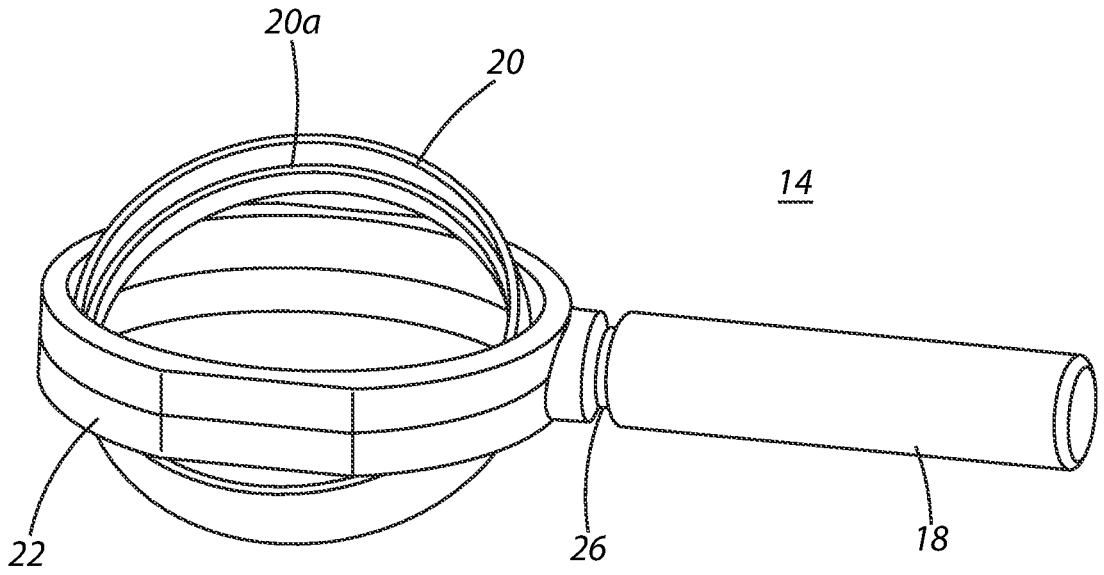
FIGS. 4A and 4B are a perspective view and a cross section view, respectively, of a filter basket that forms part of the simulated beverage dispenser of FIG. 1.
Figure 4B:
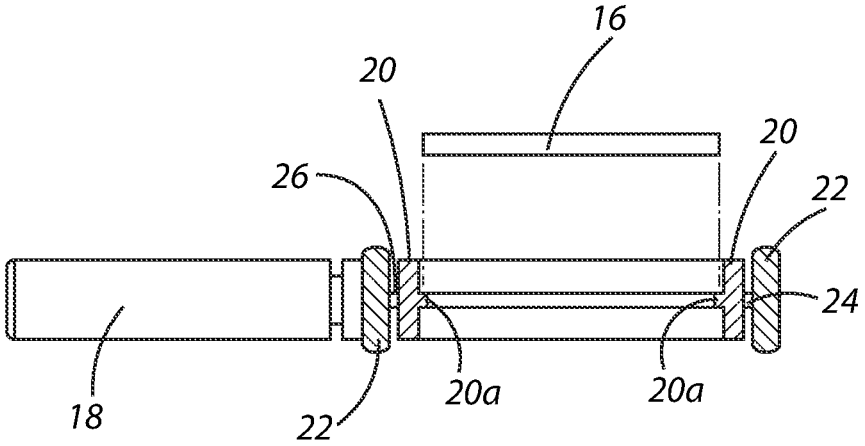

FIG. 4A shows a perspective view of filter basket 14. FIG. 4B shows a cross section of filter basket 14. Handle 18 extends from basket 14. Handle 18 is sized and shaped to allow it to be easily grasped and rotated. Shaft 26 extends from handle 18. Disc receiver 20 is fixed to shaft 26. According to one embodiment, disc receiver 20 includes a ridge 20*a* along its inside perimeter. Ridge 20*a* is sized and shaped so that, when a disc 16 is placed in disc receiver 20, the disc will be supported by ridge 20*a*. According to one embodiment, ridge 20*a* is positioned along the mid-plane of receiver 20 so that a disc 16 can be supported on either side of the receiver. According to other embodiments, ridge 20*a* is provided proximate to one side of receiver 20 so that a disc 16 can be supported on only one side of receiver 20. According to another embodiment, instead of a ridge 20*a* along the inside perimeter of receiver 20, receiver 20 has a continuous inner surface that forms a cavity 20*b* shaped to hold disc 16, as shown in the embodiments of FIGS. 9A-9D.

As best seen in FIG. 4B, shaft 26 extends through, and is rotatably supported by, ring 22. According to one embodiment, at the side of disc receiver 20 opposite from shaft 26, bearing 24 connects receiver 20 with ring 22 and allows disc receiver 20 to rotate relative to ring 22. According to other embodiments, no bearing 24 is provided and instead, receiver 20 is supported within ring 22 only by shaft 26. According to the embodiment shown in FIG. 4B, ridge 20*a* is provided along the mid-plane of disc receiver 20 so that a disc 16 can be received on either side of receiver 20. According to this embodiment, operation of the toy is simplified because the filter basket 14 can be readied to receive disc 16, regardless of which side of receiver 20 is facing upward, as will be explained below.

Figure 5A:
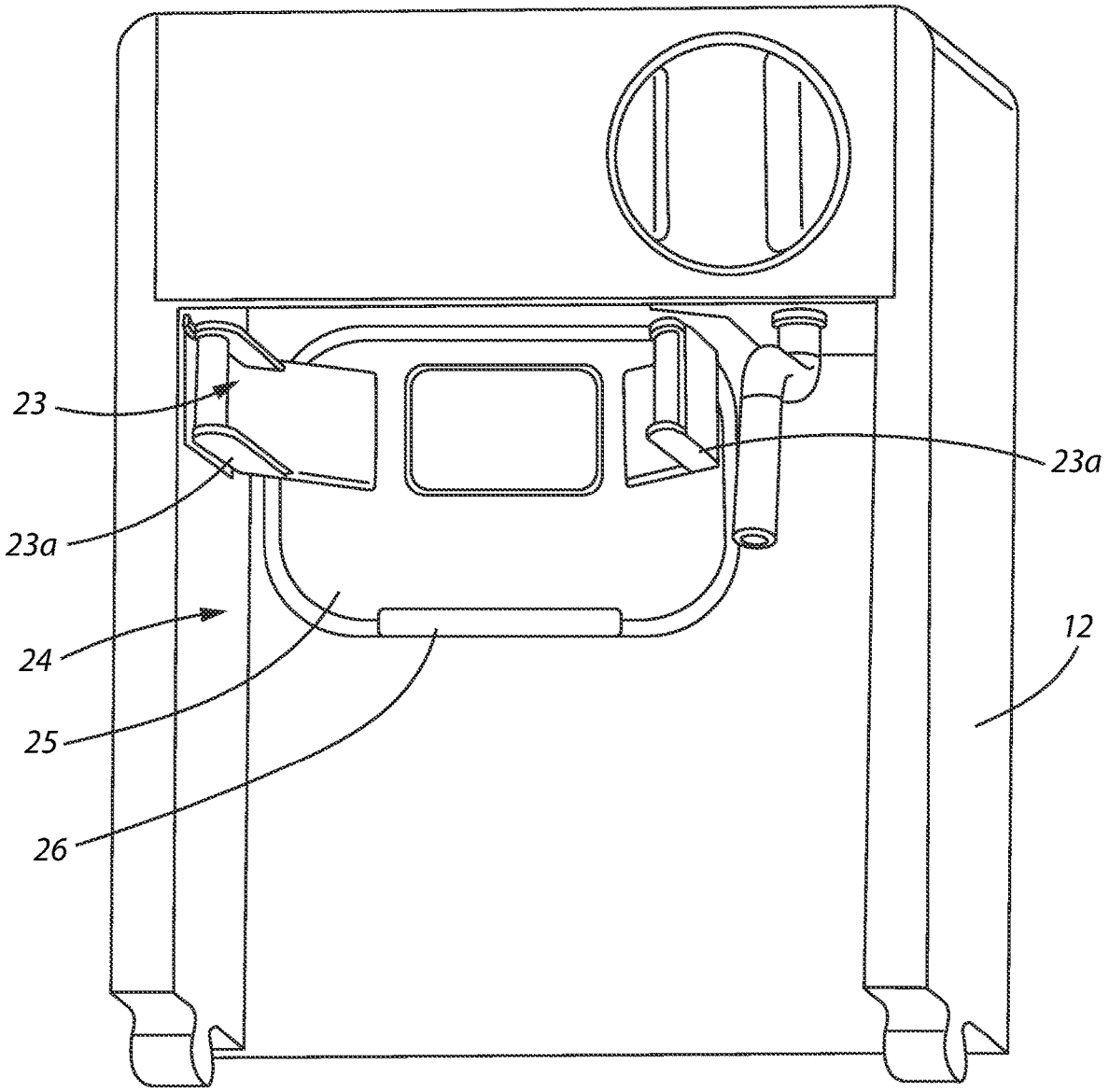
FIGS. 5A and 5B are perspective views of the frame of the simulated beverage dispenser of FIG. 1 showing insertion of a cup into the frame.
Figure 5B:
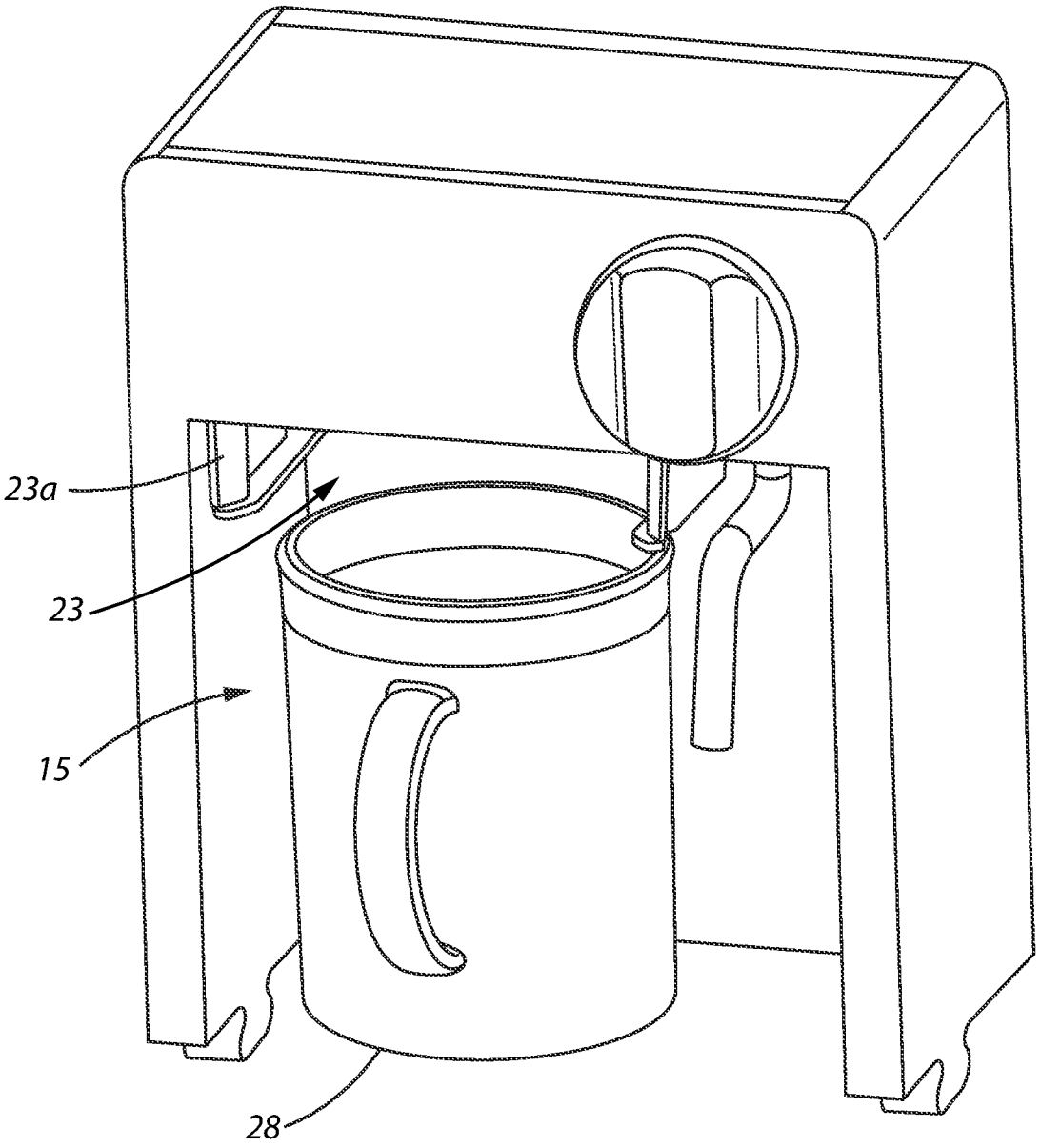

FIGS. 5A and 5B show frame 12 without filter basket 14. As best seen in FIG. 5A, slot assembly 24 is positioned within the frame 12. Slot assembly 24 provides supports 23*a* on either side of slot 23. According to one embodiment, supports 23*a* extend from a backplate 25 affixed to the inside of frame 12. According to one embodiment, supports 23*a* can be flexed outward when filter basket 14 is inserted into slot 23, as will be described below. According to one embodiment, cup engagement ridge 26 extends from backplate 25.

FIG. 5B shows a cup 28 placed in open area 15. Cup 28 is pressed against engagement ridge 26. According to one embodiment, engagement ridge 26 is shaped to conform with the outside curvature of cup 28 so that when the cup and the ridge are in contact, the cup is centered below slot 23.

Figure 6:
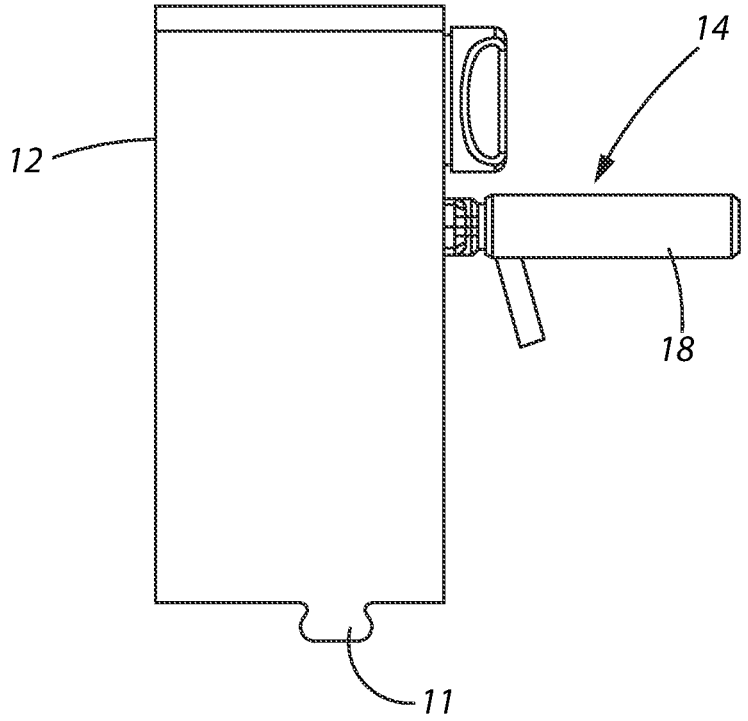
FIGS. 6 and 7 are elevation views of the simulated beverage dispenser of FIG. 1.
Figure 7:
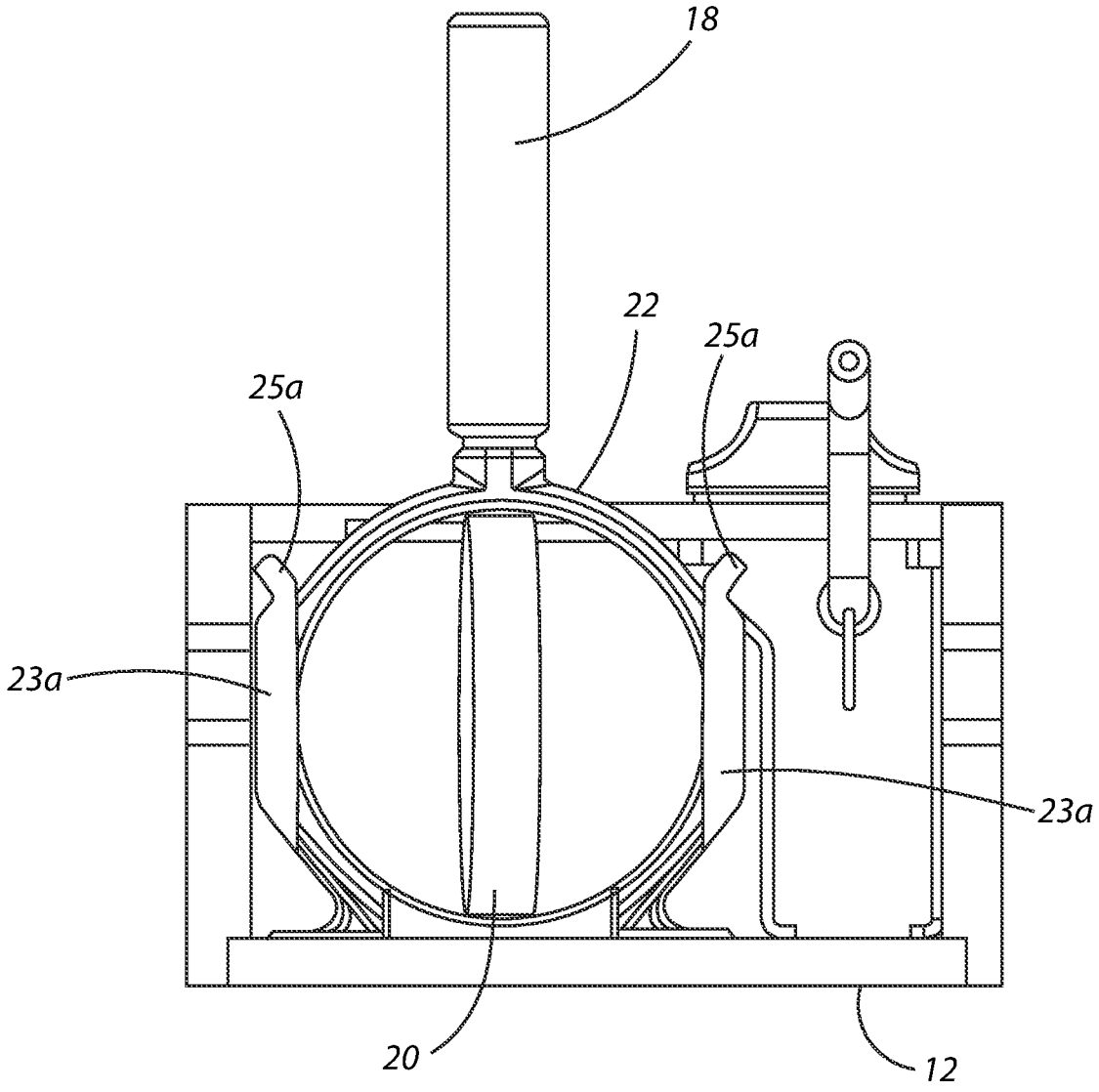

FIGS. 6 and 7 show filter basket 14 inserted into slot 23 of frame 12. FIG. 7 shows the interior of frame 12 looking upward. Supports 23*a* are provided on the left and right sides of slot 23. Supports 23*a* are adapted to allow ring 22 of filter basket 14 to be inserted into slot 23. Supports 23*a* hold ring 22, while allowing disc receiver 20 to rotate relative to ring 22. Sufficient clearance with frame 12 above slot 23 is provided to allow receiver 20 to rotate completely about the horizontal axis defined by handle 18, shaft 26, and bearing 24.

Supports 23*a* may include flexible portions or may be connected with backplate 25 by spring-driven hinges that provide an interference fit between ring 22 and slot 23. According to one embodiment, engagement of ring 22 and supports 23*a* causes filter basket 14 to removably snap into slot 23. Pulling basket 14 away from frame 12, for example, by pulling handle 18 away from frame 12 causes supports 23*a* to flex outward allowing basket 14 to disengage from slot 23. According to other embodiments, supports 23*a* each include a ramped portion 25*a* that facilitates aligning ring 22 with supports 23*a* and inserting filter basket 14 into slot 23.

Figure 8:
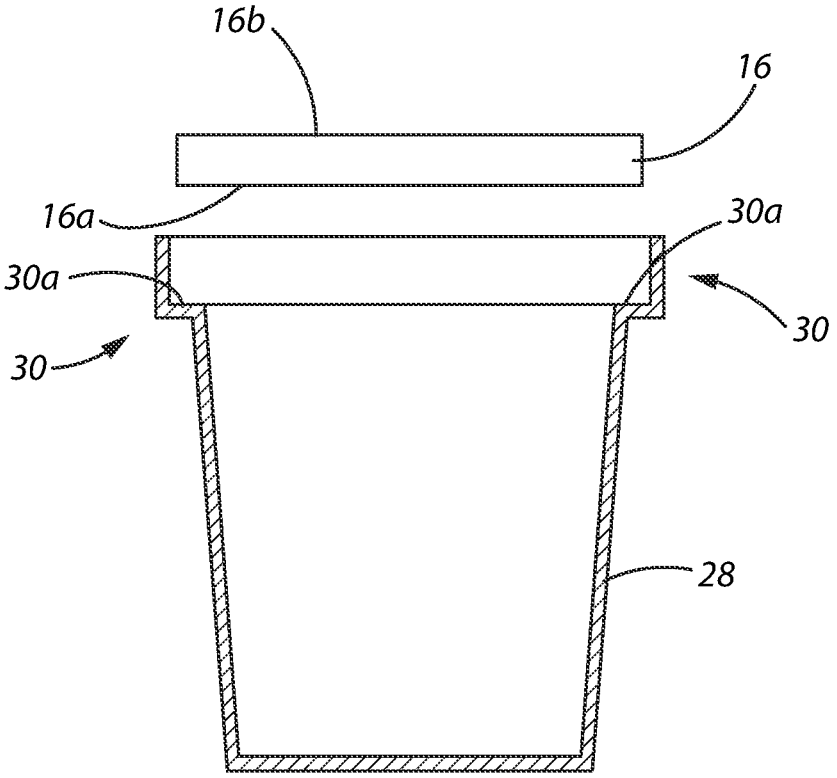
FIG. 8 is a cross section view of a cup that forms part of the simulated beverage dispenser of FIG. 1.

As shown in FIG. 5B, cup 28 is positioned in space 15 within frame 12. Cup 28 may be shaped like a coffee mug, as shown in FIG. 5B. Alternatively, cup 28 may be shaped like a disposable hot beverage cup, as shown in FIG. 9D. FIG. 8 is a cross section view of cup 28, such as the cup in FIG. 9D. The height of cup 28 is selected so that it fits in space 15 below slot 23 within frame 12. When cup 28 is positioned below slot 23, sufficient clearance is provided above the rim of cup 28 so that disc receiver 20 turns freely while ring 22 is supported within slot 23.

A stepped region 30 is provided near the top of cup 28. Stepped region 30 is shaped so that a disc 16 placed into cup 28 will rest on the step 30*a* created by stepped region 30. The diameter of the cup 28 in the stepped region 30 is larger than the diameter of the disc 16 and the diameter of the cup below the stepped region is smaller than the diameter of the disc. When a disc 16 is dropped into cup 28, step 30*a* holds the disc 16 near the top of the cup. According to one embodiment, the depth of stepped region 30 is selected to match the thickness of disc 16 so an upward facing surface of disc 16 supported by step 30*a* is coplanar with the rim of cup 28. According to other embodiments, the depth of stepped region 30 is selected so that the upward facing surface of disc 16 is above or below the rim of cup 28. Other configurations of cup 28, such as the one shown in FIG. 5B also include a stepped region for supporting disc 16 near the top rim of the cup.

FIGS. 9A-9D show operation of toy 100 according to an embodiment of the disclosure. As shown in in FIG. 9A, cup 28 is placed in space 15 within frame 12 below slot 23. Filter basket 14 is removed from slot 23 and arranged so receiver 20 is aligned with ring 22 and the receiver is held horizontally. A disc 16 is selected. According to one embodiment, first face 16*a* of disc 16 is decorated to represent ground coffee. Disc 16 is placed in receiver 20 with face 16*a* oriented upward. According to this embodiment, receiver 20 has a continuous inner surface forming cavity 20*b* that is shaped to hold disc 16.

Figure 9A:
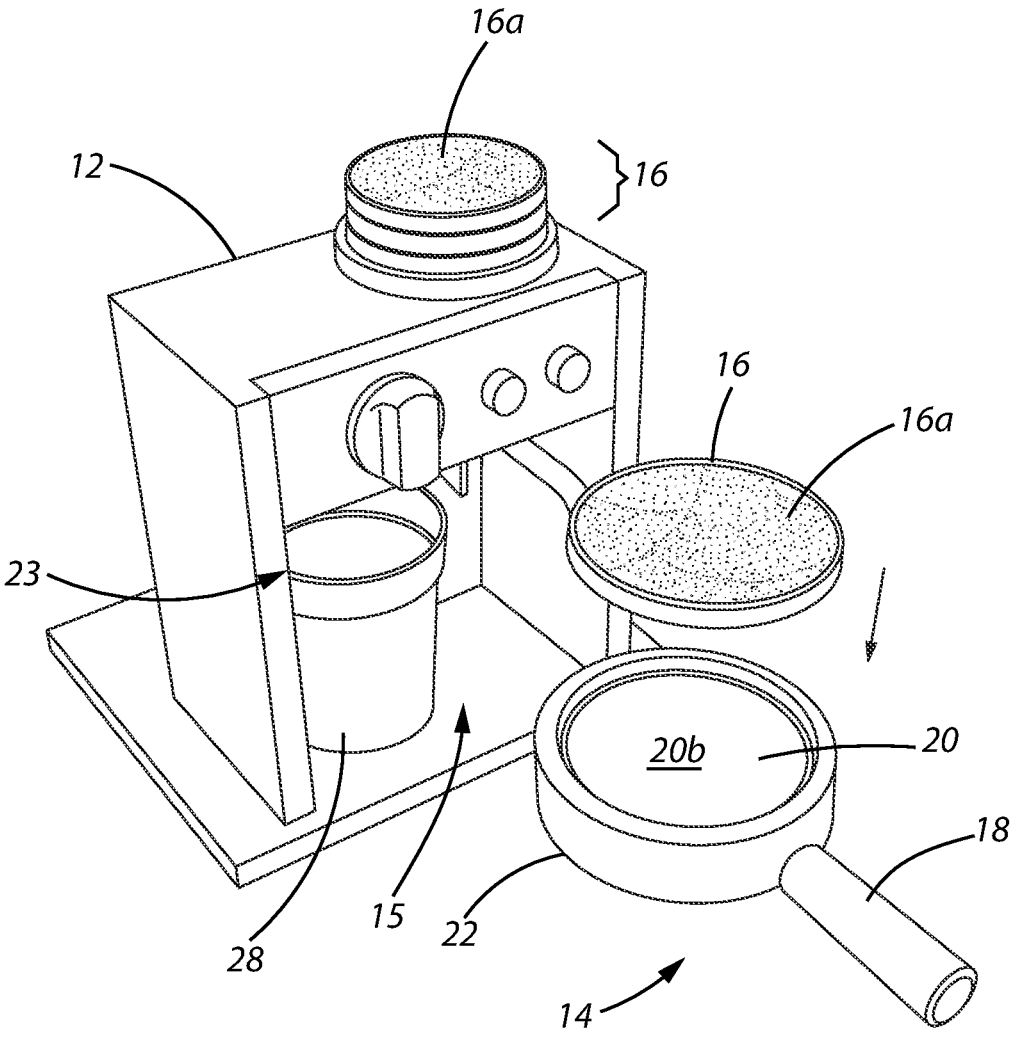
FIGS. 9A, 9B, 9C, and 9D are perspective views showing steps for using a simulated beverage dispenser according to embodiments of the disclosure.
Figure 9B:
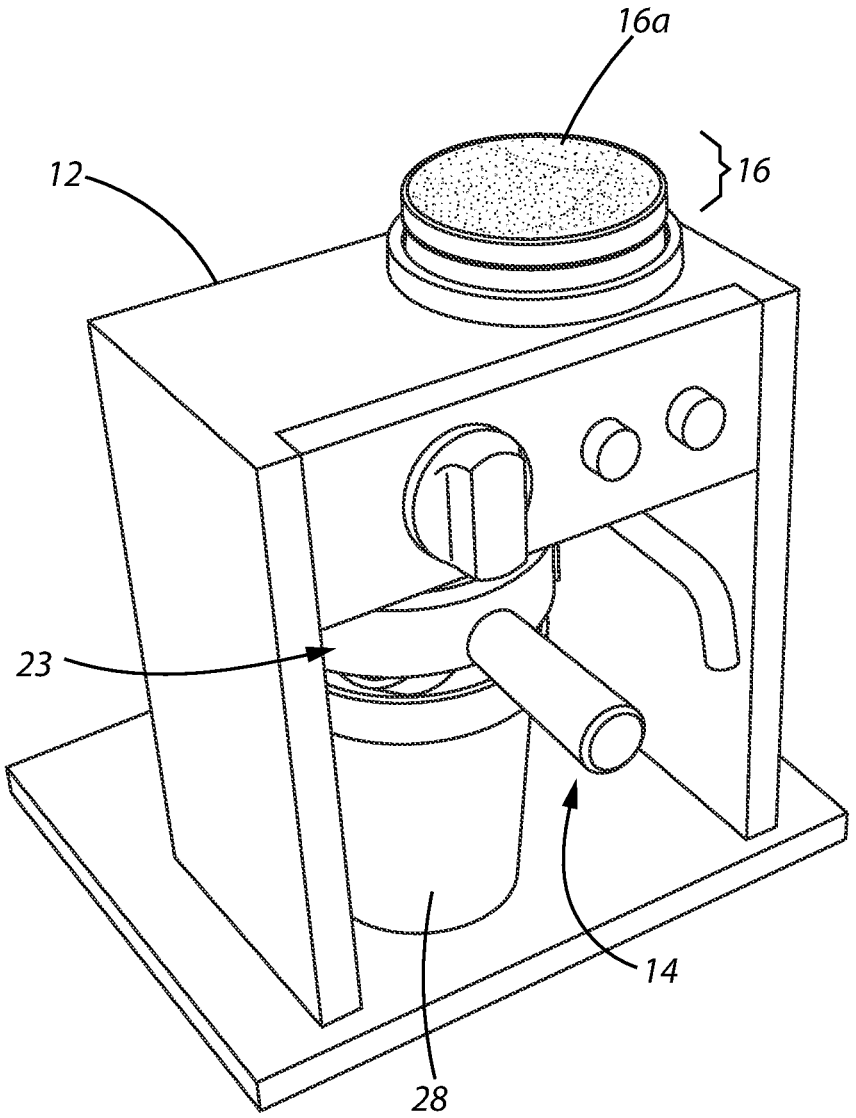

As shown in FIG. 9B, filter basket 14 is inserted into slot 23 of frame 12 with ring 22 engaged with supports 23*a*. Supports 23*a* flex outward as filter basket 14 is inserted into slot 23 to provide a tactile snap-fit when ring 22 is fully engaged with supports 23*a*. Ring 22, disc receiver 20, and disc 16 are positioned within slot 23 and above the top of cup 28. Cup 28 is placed against engagement ridge 26 to assure that the cup is centered below slot 23.

Figure 9C:
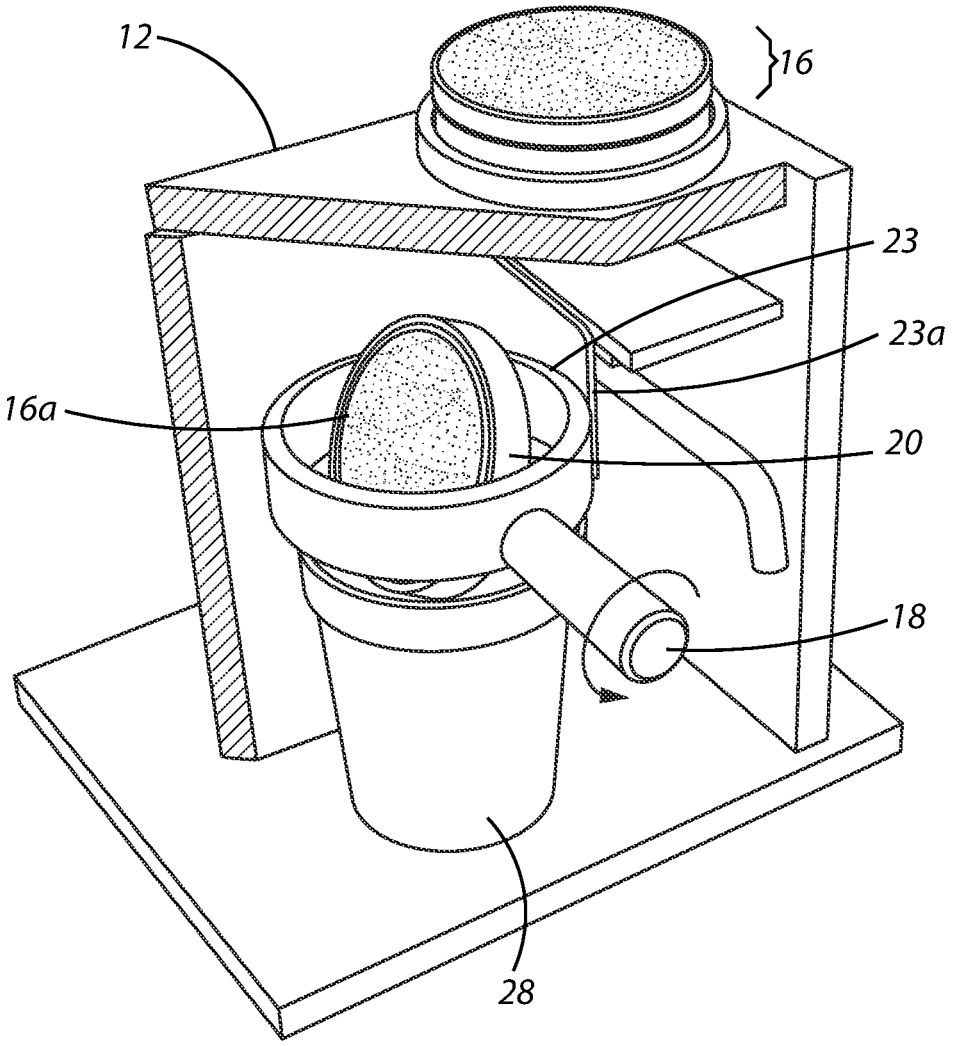
Figure 9D:
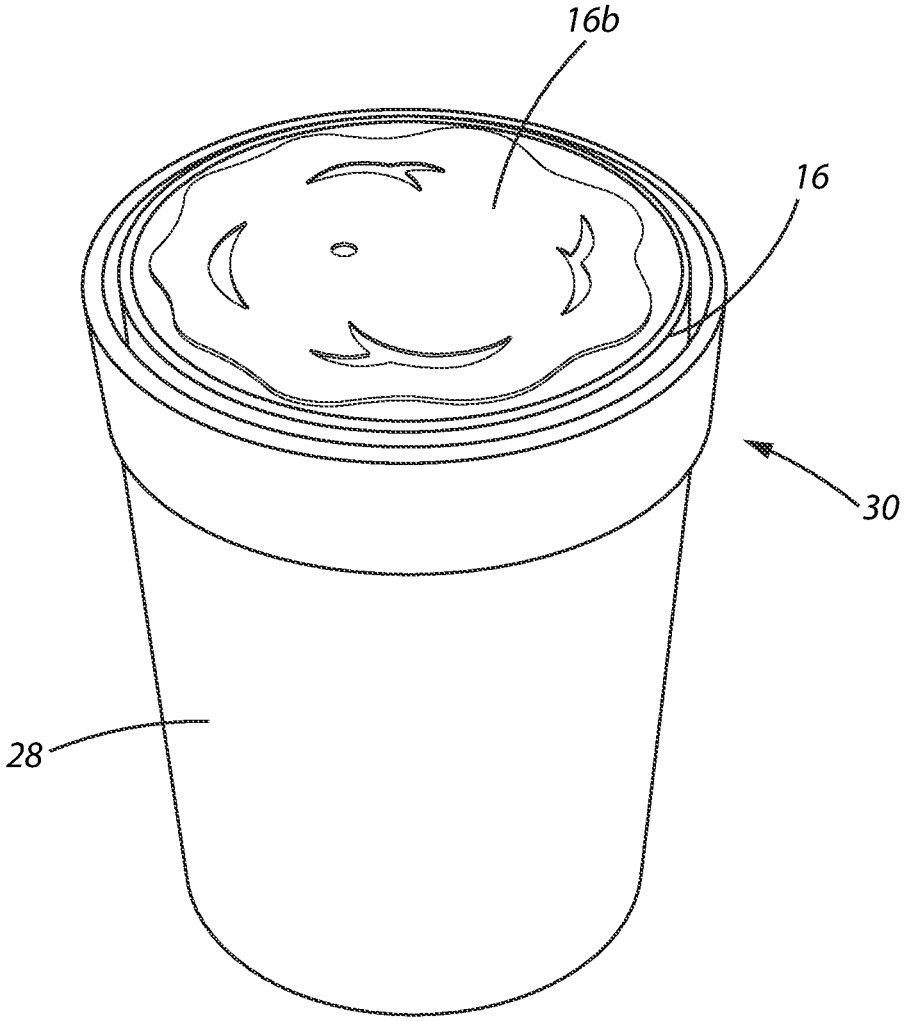

FIG. 9C is a partial cut away view of toy 100 showing the operation of filter basket 14 within frame 12. In this view, only one support 23*a* is visible, the other support being removed for clarity. Handle 18 is rotated about the horizontal axis, causing disc receiver 20 to rotate. When disc receiver 20 is rotated so that cavity 20*b* holding disc 16 is directed downward, disc 16 falls from disc receiver 20 and into cup 28. Disc 16 falls onto step 30*a* of stepped region 30 with the disc being supported near the top of cup 28. Because disc 16 was inverted when disc receiver 20 was rotated about the horizontal axis, as shown in FIG. 9C, the second face 16*b* of disc 16 is now facing upward. Face 16*b* is decorated to represent the surface of the dispensed beverage, here a creamy surface of a latte or cappuccino. As shown in FIG. 9D, the cup is removed from frame 12 with face 16*b* positioned upward in the cup, representing the finished beverage.

While the invention has been particularly shown and described with reference to exemplary embodiments thereof, the invention is not limited to these embodiments. It will be understood by those of ordinary skill in the art that various changes in form and details may be made therein without departing from the spirit and scope of the invention as defined by the following claims. Therefore, the description should not be construed as limiting the scope of the invention.

What is claimed is:

1. A toy beverage dispenser comprising:
a frame including a slot;
a filter basket, the filter basket comprising:
a handle;
a disc receiver fixed with the handle; and
a ring surrounding the disc receiver, wherein the handle and the disc receiver are rotatably connected with the ring to rotate about a horizontal axis, and wherein the ring is shaped to removably fit into the slot;
a disc including a first face and a second face; and
a cup,
wherein the cup is shaped to fit within the frame below the slot, wherein the disc receiver is shaped to support the disc when the disc receiver is oriented substantially horizontally and wherein the disc falls from the disc receiver into the cup when the disc receiver is rotated about the horizontal axis.

2. The dispenser of claim 1, wherein the first face comprises a decoration representing a material used to create a simulated beverage and wherein the second face comprises a decoration representing a top surface of the simulated beverage.

3. The dispenser of claim 1, wherein the cup is shaped to receive the disc and to hold the disc in a horizontal orientation.

4. The dispenser of claim 1, wherein the disc receiver comprises a first cavity shaped to releasably hold the disc.

5. The dispenser of claim 4, wherein the disc receiver further comprises a second cavity on a side opposite from the first cavity, wherein the second cavity is shaped to releasably hold the disc.

6. The dispenser of claim 1, wherein the slot includes one or more supports, wherein the supports releasably hold the ring within the slot.

7. The dispenser of claim 1, wherein the cup comprises a stepped region proximate an upper rim of the cup, and wherein a diameter of the cup above the stepped region is larger than a diameter of the disc and wherein the diameter of the cup below the stepped region is less than the diameter of the disc, wherein, when the disc falls into the cup, the disc is supported by the stepped region.

8. The dispenser of claim 7, wherein the height of the stepped region is less than, equal to, or greater than a thickness of the disc.

9. A method of simulating dispensing a beverage comprising:
providing one or more discs, the discs each including a first face and a second face;
providing a simulated filter basket, the basket shaped to receive a selected disc of the one or more discs in a disc receiver, wherein the disc receiver is rotatable about a horizontal axis;
positioning a cup below the simulated filter basket;
orienting the disc receiver horizontally;
inserting the selected disc in the disc receiver with a first face of the disc facing upward; and
rotating the disc receiver about the horizontal axis, wherein the disc falls from the disc receiver and into the cup with the second face of the disc facing upward.

* * * * *